United States Patent [19]

Taylor

[11] 4,128,974

[45] Dec. 12, 1978

[54] FASCIA AND GUTTER SYSTEMS ON BUILDINGS

[75] Inventor: Harry E. Taylor, Tauranga, New Zealand

[73] Assignee: G. W. Taylor Industries Limited, Taurangan, New Zealand

[21] Appl. No.: 821,065

[22] Filed: Aug. 2, 1977

[51] Int. Cl.[2] ..... E04D 13/00

[52] U.S. Cl. ..... 52/11

[58] Field of Search ..... 52/11, 12, 15, 16; 248/48.1, 48.2

[56] References Cited

U.S. PATENT DOCUMENTS 3,344,562 10/1967 Miles et al. ..... 52/11

FOREIGN PATENT DOCUMENTS 272934 1/1965 Australia ..... 52/11

1370694 7/1964 France ..... 52/11

*Primary Examiner*—Price C. Faw, Jr.

*Assistant Examiner*—Carl D. Friedman

*Attorney, Agent, or Firm*—Ladas, Parry, Von Gehr, Goldsmith & Deschamps

[57] ABSTRACT

Disclosed is a combination fascia and concealed gutter system comprising a plurality of similar support members arranged for securement in substantially horizontal aligned relationship on a support structure below the periphery of a roof of a building.

16 Claims, 5 Drawing Figures

FASCIA AND GUTTER SYSTEMS ON BUILDINGS

This invention relates to fascias and gutters for buildings, and more particularly relates to a combination fascia and concealed gutter system or assembly of metal or plastics materials. A concealed gutter system or assembly being one in which a gutter channel member is located between the building and a fascia so as to be substantially concealed by the fascia when viewed from below or generally horizontally.

An object of this invention is to provide an improved combination fascia and concealed gutter system of the kind referred to and including a detachable spring fitted gutter facilitating fitment, replacement and maintenance of the gutter.

Another object of the invention is to provide a combination fascia and gutter system capable of being manufactured and sold at relatively low cost, and having a general design facilitating erection with a minimum of effort and skill.

Other objects and advantages of the invention will become apparent from the ensuing description.

According to this invention therefore, there is provided a combination fascia and concealed gutter system comprising a plurality of similar support members arranged for securement in substantially horizontal aligned relationship on a support structure below the periphery of a roof of a building, a metal or plastics fascia member shaped and arranged for engagement with said support members when secured, and a gutter channel member into which water from the building roof can flow shaped and arranged for detachable spring fitment within the support members; each support member being shaped to engage and support inner, outer and base parts of the gutter member and being further provided with a lower outer edge portion about which an inturned and upturned lower longitudinal edge portion of the fascia member can locate, and an inset upper edge portion on which an inwardly disposed returned upper edge portion of the fascia member can bear, and the gutter member having an upper outer longitudinal edge portion shaped and arranged to contact said fascia returned upper edge portion.

According to a second aspect of this invention, there is provided a fascia and concealed gutter system comprising a plurality of similar metal or plastics support members arranged for disposition in substantially horizontal aligned relationship with inner parts secured to a support structure below the periphery of a roof of a building, a metal or plastics fascia member arranged for generally horizontal disposition along its length and engagement with upper and lower outer edge portions of said secured support members, and a gutter channel member into which water from the building roof can flow arranged for detachable spring fitment within and support by medial parts of the support members; each support member having an outer upwardly directed part against which an outer wall of the gutter member can rest and provided with a plurality of inwardly directed projections any one of which can form an abutment for an upper longitudinal ledge or edge of the gutter member outer wall to prevent upward movement and determine the longitudinal fall of the gutter member when engaged with the support members.

Some preferred aspects of the invention will now be described by way of example and with reference to the accompanying drawings, in which.

Figure 1:
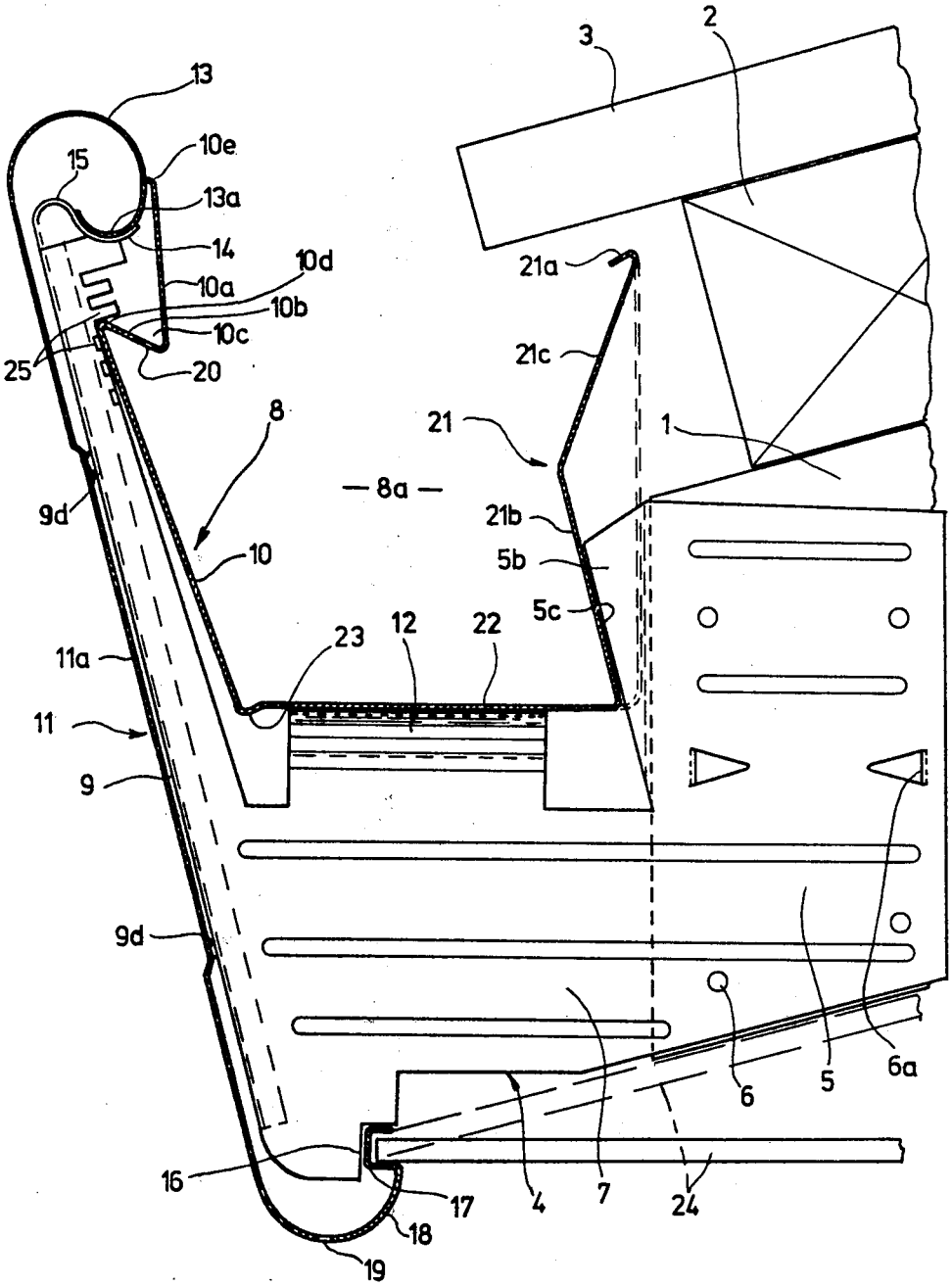
FIG. 1 is a sectional view of one preferred fascia and gutter system or assembly in accordance with the invention.
Figure 2:
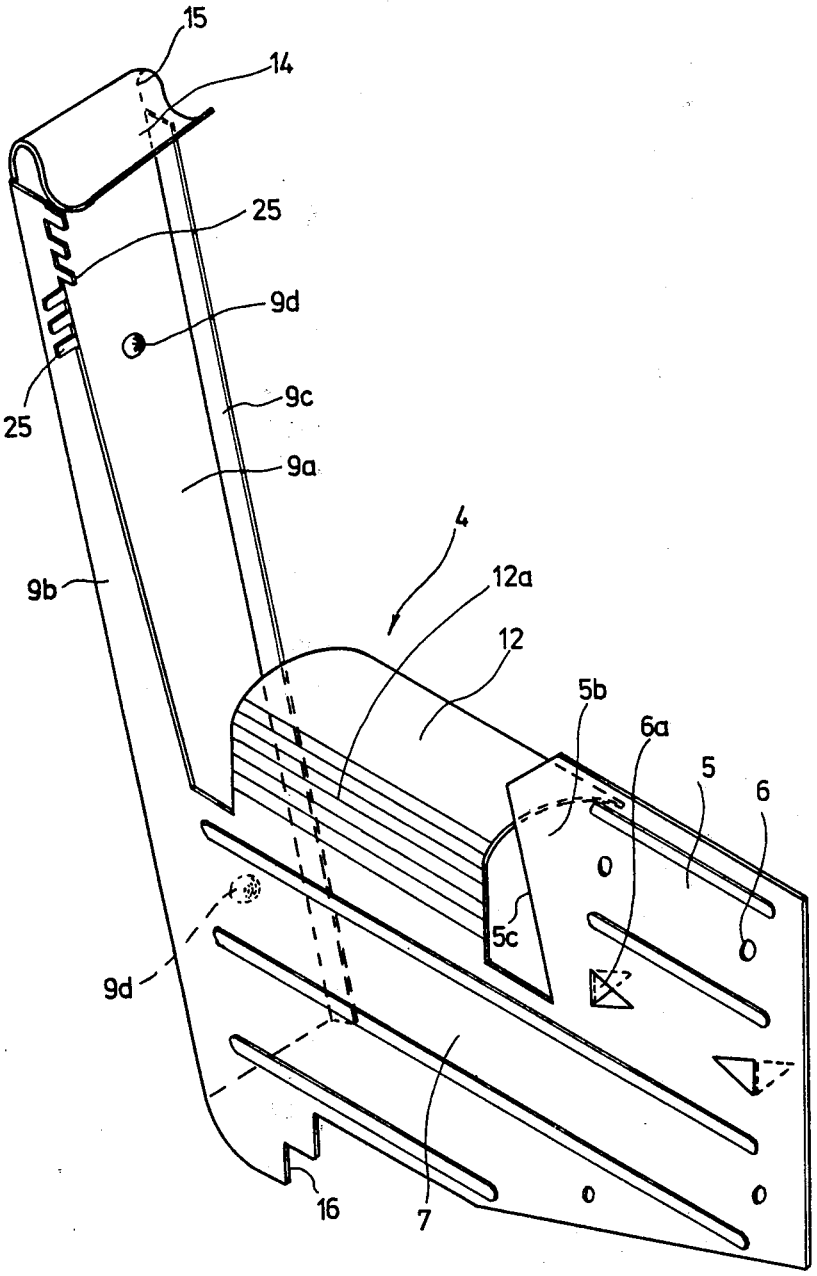
FIG. 2 is a perspective view of the preferred support member in accordance with the invention and shown in the system of FIG. 1.

In the preferred application and forms of the invention, the combination fascia and gutter system or assembly provided is an economical, tidy and pleasing way of finishing roof peripheral edges at the eaves and soffits of buildings, particularly domestic dwellings. Typically such building roof structures include inclined rafters 1 with transverse horizontal purlin members 2 supporting the roofing material 3 e.g. metal or tiled roofing material.

The rafters 1 are terminated short of the roofing material 3 periphery so that such roofing material 3 overhangs the rafters 1 slightly, and the support members (generally indicated by the arrow 4) in accordance with the invention each include an inner flat vertically disposed plate part 5 which may be provided with preformed nail or screw holes 6 and is arranged for nailing or screwing (or bolting, screwing or rivetting in the case of securement to metal framing) to a rafter end portion, at one side thereof so that a medial vertically disposed support plate part 7 (below the upper edge of the inner end part 5) extends from the secured inner end part 5 in general alignment with the respective rafter 1 for substantially the width of the gutter channel member (generally indicated by the arrow 8) to be utilised with the assembly, and an outer support part 9 for the gutter outer wall 10 and fascia member (generally indicated by the arrow 11) extends integrally from such medial support plate part 7.

At the junction between the secured end part 5 and medial support plate part 7, the height of the support member 4 may be substantially equivalent to the typical depth of a rafter end, the lower edge of the support inner end part 5 being also preferably inclined to conform with the usual inclination of the lower edge of a rafter 1 and permit fitment of a sloping soffit panel 24.

In one preferred form of the invention each support member 4 is fabricated from a single piece of sheet metal e.g. galvanised steel, copper or aluminium (complementary to the material utilised for the construction of the gutter channel member 8 and the fascia member 9 so that no adverse electrolytic action may be set up between abutting parts of the assembly), and vertical adjustment at such medial support part 7 for determining the correct fall of the gutter channel member 8, whilst providing adequate support thereto, is preferably provided by means of a turned over bendable tab or flap member 12 formed integrally with and extending laterally up and over from the upper edge part of the medial support plate part 7, so that such tab or flap member 12 can be easily further bent or adjusted to the required height to create the required longitudinal fall of the gutter channel member 8.

In a modification of the invention, particularly applicable in the case of support members 4 constructed from plastics materials not likely to remain at positions to which bent, it is envisaged that the tab or flap member 12 can initially extend upwardly from the main medial support part 7 and such member 12 is provided with a series of preferably equally spaced (one above the other) horizontal lines 12*a* at which the material is weakened, such as by scoring after forming, forming grooves or reduced thickness lines during molding (in plastics) or by providing aligned perforations or slits, at any one of which lines the upper portion of the tab or flap member 12 can be bent over or severed from the remainder. The provision of equally spaced bend or severing lines 12*a* may have added advantage in providing a graduated scale by which an evenly graduated gutter fall can be readily attained.

Figure 5:
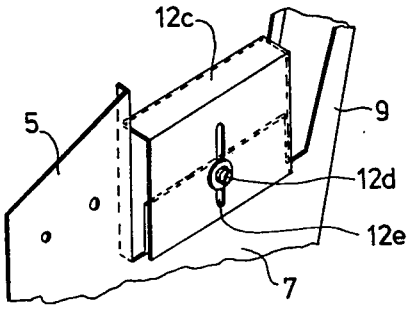
FIG. 5 is a fragmentary perspective view of a modification to the support member.
Figure 3:
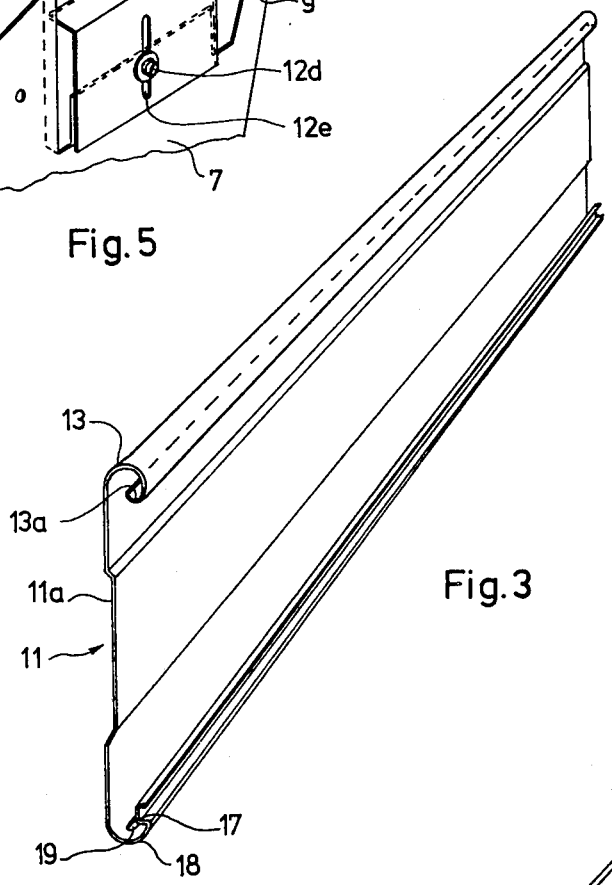
FIG. 3 is a perspective view of a fragment of the preferred fascia member shown in the assembly of FIG. 1.

It is envisaged that other vertical height adjustment means can be provided e.g. such as by the example shown in FIG. 5 which includes a separately formed bearing member 12*c* secured such as by a bolt or screw 12*d* to the medial part 7 and through a vertical slot 12*e* in one or both parts (12*c* or 7), but the previously described and illustrated turned over or bendable or severable tab or flap 12 more simply adjusts to the correct height before or after fitting of the gutter channel and further permits the support member 4 to be easily and economically manufactured from a single piece of sheet metal.

The support member inner and medial parts 5 and 7 are integral and generally flat and co-extensive, and may be provided with at least one but preferably a plurality of horizontally disposed strengthening ribs (pressed out from one side in a sheet metal construction) and, in the case of a sheet metal construction, timber engaging spikes or prongs 6*a* can be pressed out laterally of the inner end part 5 to facilitate initial location of each support member 4 before final securement.

The outer part 9 of the support member 4 extends upwardly beyond the medial support part 7 to provide support to the outer wall 10 of the gutter channel member 8, and to the fascia member 11. Such outer part 9 may be of upstanding channel formation with a flat web portion 9*a* extending normal to the plane of the bracket inner and medial parts, 5 and 7, an inwardly directed inner flange portion 9*b* above the medial support part 7 and an inwardly directed outer flange portion 9*c* parallel thereto in providing a substantially rigid and strengthened outer support part 9. The fascia member 11 is preferably provided with a medial wide and flat longitudinal inset or rib formation 11*a* for added strength and a decorative appearance and has an upper longitudinal edge edge portion 13 rolled over so that the under edge portion 13*a* may locate on and in an upper arcuate inturned edge portion 14 integral with the outer part web portion 9*a* and extending from an inverted channel portion 15 at the upper end of the web portion 9*a* and which can locate partially within the rolled formation 13 of the fascia member 11 for secure fitment. The inset or rib formation 11a can be arranged to lie flat against the outer face of each support web portion 9*a* but there may be a risk, particularly if thin gauge material is used in the construction of the fascia member 11, of stress marks forming and showing on the outer surface of the fascia member and this risk can be eliminated by forming upper and lower slight projections 9*d* (by depressing or dimpling the inner side) on the web portion 9*a* and arranged to locate against the stronger edge portions of the fascia inset or rib formation 11*a* and hold the fascia member 11 in slight spaced relationship from the web portion 9.

The lower outer edge part of the support member extends slightly below and in the same plane as the flange portion 9*b* and the medial part 7 to provide an inner stepped formation 16 forming a positive abutment for an inner returned longitudinal edge portion 17 at a lower longitudinal rolled edge part 18 of the fascia member 11 extending inwardly and upwardly to form a combination water channel and finishing bead. Such water channel 18 being provided in its base preferably with a plurality of longitudinally spaced drain apertures or slots 19 (e.g. 1 × ⅛ inch slots at approximately 12 inch spacing) whereby any water overflowing from the gutter member 8 or infiltrating between the gutter member 8 outer wall 10 and the fascia member 11 can be drained therefrom.

The gutter channel member 8 is preferably of non-conventional angular cross-sectional shape made so as to be complementary to the support members 4, and the gutter member 8 has a flat base wall 22 which may be supported from below for substantially its full width by the tab or flap member 12 of each support member 4, and an outer wall 10 having at least a part of which can rest on at least one of the inner edges of the flange portions 9*b* and 9*c* of the support member outer part 9. The upper edge portion 10*a* of the gutter member 8 is turned inwardly and downwardly and then upwardly so as to bear in spring fit against the inner side of the fascia member rolled upper edge portion 13 to minimise the possibility of water creeping between the upper edge of the gutter member outer wall 10 and such fascia member upper rolled edge portion 13. Preferably the uppermost edge 10*e* of the outer wall 10 is turned fractionally outwardly to provide a strengthened and relatively sharp edge arranged to bear in substantially sealing contact with the fascia upper rolled edge 13 on the side directed inwardly of the gutter member 8 and medially thereof.

The inturned and downturned portion 10*b* of the gutter member outer wall 10 forms an outer upper channel 10*c* with the upwardly extending edge portion 10*a* and is preferably provided with a plurality of spaced apertures or slots 20 (e.g. again 1 × ⅛ inch slots at approximately 12 inch spacing) so that any water infiltrating between the outer wall upper edge 10*a* and the fascia member upper rolled edge portion 13 can drain through such apertures 20 into the gutter channel 8*a*. The apertures or slots 20 and the upper edge 10*d* of the inclined portion are below the level of the inner wall upper edge 21*a* so that such apertures 20 may also act as overflow apertures 20 through which excess water in the gutter channel 8*a* can overflow in the event of excessive rainfall or gutter blockage so that such excess water does not overflow the inner wall 21 and adversely affect the building parts below the roof 3, any water overflowing through the apertures 20 can be drained from the fascia member lower apertures 19 in the lower rolled edge portion 18. The junction at the gutter member outer wall 10 and base 22 is preferably relatively sharp and extends below the base 22 to provide a drip edge 23 disposed above the fascia lower edge part 8 or channel to counter capillary action and prevent any overflow water from running under the gutter base 22 and dripping onto the soffit panel 24 or contacting the building structure parts and causing leakage and damage.

The returned inner lower edge portion 17 of the fascia member 11 preferably also forms an elongate channel directed towards the building and capable of receiving an edge portion of the soffit panel 24 which may be inclined under the rafter end portions (as shown in broken outline) or supported generally horizontal (as shown in full).

In a preferred embodiment of this invention the support inner end part 5 is provided with an inwardly extending portion **5*b* preferably of triangular or like formation and the inner wall 21 of the gutter member 8 complementary in shape with a lower part of the wall angled inwardly at 21*b* from the base 22 and then returned in an inclined direction outwardly at 21*c*. The outwardly angled disposition of portion 21*c* ensures that the upper part of the gutter is kept as wide as possible for the receipt of water and to facilitate cleaning. The upper longitudinal edge of the inner wall 21** is preferably inturned and downturned for added strength.

The upper portion of the support member outer part 9 is provided with a plurality of inwardly directed projections or lugs 25 one above the other and any one of which can be selected to act as a stop to prevent upward movement of gutter member outer wall 10 and such that in conjunction with the lower inclined edge **5*c* of triangular portion 5*b* which contacts the inner wall part 21*b*, a selected lug 25 prevents upward movement of gutter member 8** at the respective support member.

In the preferred embodiment of gutter member 8 described and illustrated the selected lug 25 is arranged to bear on and overlie the ledge or edge formed by junction **10*d*, but it is envisaged that in a gutter without the inturned and upturned upper outer wall part, the upper edge of the outer wall can be arranged to locate under the selected lug 25**.

Where gutter member 8 is to be held at its lowest position of fall e.g. at a downpipe (not shown), tab or flap 12 is bent down or severed to the lowest necessary height and the upper ledge or edge **10*d* of gutter outer wall 10 is held down by the lowest selected lug 25**.

Where gutter member 8 is to be held at its lowest position to fall e.g. at a downpipe (not shown), tab or flap 12 is bent down or severed to the lowest necessary height and the upper ledge or edge **10*d* of gutter outer wall 10 is held down by the lowest selected lug 25. Conversely, for the highest gutter position the highest tab or flap position and the appropriate highest lug 25 are selected. To arrange progressive fall in the gutter member 8 intermediate positions of heights of the tab or flap 12 and intermediate lugs 25 are selected. Any lower lug or lugs 25 which will foul the gutter is or are bent to one side or broken off and clear of the gutter member 8. In the drawings, as will be seen by way of example, the gutter is shown at midway of its longitudinal fall and the lowermost lugs 25 have been bent to one side so as not to foul gutter wall 10, the next in succession lug 25 remaining in its extended position to prevent upward movement of wall 10**.

The projections or lugs 25 are preferably all similar and equally spaced, for example the lugs may be ⅛ inch in height and spaced ⅛ inch apart one above the other, so that with regular horizontal spacing of the support members 4 successive selected lugs 25 withhold the gutter member 8 at an evenly graduated fall. Where the tab or flap 12 is provided with weakened bend or severing lines, or otherwise graduated for selected height positions, such graduated positions or line spacings are complementary to the lug spacings and height, and the outer wall 10 height from the base 22 to the upper ledge or edge **10*d*. Each tab or flap member 12 can be prebent over in an arcuate manner and raised or lowered as required before spring fitting the gutter member 8 into the support members 4, but it is envisaged that the respective tabs or flaps 12 can be forced down to the required supporting height as the gutter member 8 is pressed downwardly into position and held there by the selected lugs 25**.

Figure 4:
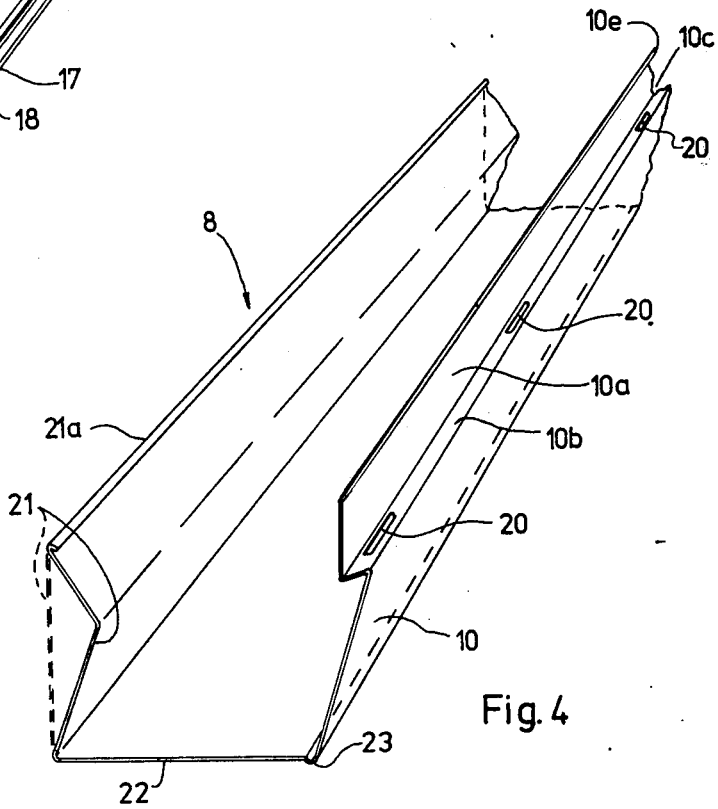
FIG. 4 is a perspective view of a fragment of the preferred gutter member shown in the assembly of FIG. 1.

In a modification of the invention, and as indicated in broken outline in FIGS. 1 and 4 of the drawings, the gutter rear wall 21 can be substantially vertical and to faciliate fitment of the support members 4 and dispense with the need for measuring for correct location (where the rafters 1 are pre-cut or trimmed with the correct overhang), the support inner end part 5 can be provided with a right angled flange portion **5*a* above the medial part 7 and forming an abutment to abut a rafter 1 end at the junction between the secured end part 5 and medial support plate part 7**.

Particular embodiments of the invention have been described and illustrated by way of example, but it will be appreciated that other variations of and modifications to such embodiments can take place without departing from the scope of the appended claims.

I claim:

1. A combination fascia and concealed gutter system comprising a plurality of similar support members arranged for securement in substantially horizontal aligned relationship on a support structure below the periphery of a roof of a building, a metal or plastics fascia member shaped and arranged for engagement with said support members when secured, and a gutter channel member into which water from the building roof can flow shaped and arranged for detachable spring fitment within the support members; each support member being shaped to engage and support inner, outer and base parts of the gutter member and being further provided with a lower outer edge portion about which an inturned and upturned lower longitudinal edge portion of the fascia member can locate, and an inset upper edge portion on which an inwardly disposed returned upper edge portion of the fascia member can bear, and the gutter member having an upper outer longitudinal edge portion shaped and arranged to contact said fascia returned upper edge portion.

2. A combination fascia and concealed gutter system as claimed in claim 1 wherein each support member, comprises an inner part arranged for securement to a support structure below the periphery of a roof of a building, a medial part shaped to receive and support the gutter channel member and an outer upwardly directed part with which the metal or plastics fascia member can be engaged for support of said fascia member, said outer part of each support member having a plurality of inwardly directed fixed projections any one of which can form an abutment for an upper longitudinal ledge or edge of the gutter member outer wall to prevent upward movement and to determine the longitudinal fall of the gutter member when engaged with a plurality of the support members mounted in horizontal aligned relationship.

3. A combination fascia and concealed gutter system as claimed in claim 2 wherein the gutter member outer wall is inturned and downturned to form the upper ledge or edge for location under and abutment with a selected projection of each support member outer part.

4. A combination fascia and concealed gutter system as claimed in claim 2 wherein each support member is fabricated from a single piece of sheet metal with the inner and medial parts substantially flat and in the same plane and provided with at least one horizontally disposed strengthening rib and wherein a plurality of timber engaging spikes or prongs are pressed out laterally of the inner part.

5. A combination fascia and concealed gutter system as claimed in claim 2 wherein the outer part of each support member is of upstanding channel formation and the projections are in the form of similar equally spaced lugs directed inwardly from one inwardly directed flange portion of the channel formation, any of said lugs below the upper ledge or edge of the gutter outer wall to be abutted being bendable laterally of or broken off from the flange portion.

6. A combination fascia and concealed gutter system as claimed in claim 1, wherein each support member is integrally formed with an inner part shaped and arranged for securement to a support structure and providing an abutment for the gutter member inner wall, a medial part with a variable height bearing portion for supporting the base of the gutter member, and an outer part extending upwardly beyond the medial part to provide support for a front wall of the gutter member and for the fascia member.

7. A combination fascia and concealed gutter system as claimed in claim 6 wherein the bearing portion of each support member is in the form of a bendable tab or flap extending upwardly from the medial part and being bent or bendable laterally thereof.

8. A combination fascia and concealed gutter system as claimed in claim 6 wherein the bearing portion of each support member is in the form of a tab or flap extending upwardly from the medial part and has a series of horizontal bend or severing lines disposed one above the other and at which said medial part is weakened so that the upper part of the tab or flap can be bent over laterally or severed from the remainder at any one of said lines.

9. A combination fascia and concealed gutter system as claimed in claim 6 wherein the bearing portion of each support member is formed separately from the remainder and is adjustably secured to the medial part of the support member by a fastener.

10. A combination fascia and concealed gutter system as claimed in claim 1 wherein the fascia member upper longitudinal edge portion is a rolled rounded edge portion and the upper edge portion of each support member is a continuation of flat strip disposed normal to the general plane of the support member turned inwardly, downwardly and upwardly in that order to form an arcuate seat complementary to and shaped and arranged to receive the lower part of the fascia member upper rolled edge.

11. A combination fascia and concealed gutter system as claimed in claim 1 wherein the gutter channel member is of substantially angular cross-section with substantially flat rear, base and front wall parts and substantially sharp corners at the junctions between such parts.

12. A combination fascia and concealed gutter system as claimed in claim 1 wherein the upper outer longitudinal edge portion of the gutter channel member is inclined inwardly and downwardly and then directed upwardly for its upper edge to bear in spring fit engagement against the fascia member upper longitudinal edge portion.

13. A combination fascia and concealed gutter system as claimed in claim 12 wherein a plurality of longitudinally spaced water overflow apertures are provided at or near the base of the upper channel formed by said downwardly inclined and upwardly directed parts of the gutter member, and a plurality of longitudinally spaced drain apertures are provided in the base of the channel formed by the inturned and upturned lower longitudinally edge portion of the fascia member.

14. A combination fascia and gutter system assembly as claimed in claim 1 wherein the gutter member is of angular cross-section with a substantially flat base and an inner wall which is inclined inwardly of and upwardly from said base and then upwardly and rearwardly towards the support structure, the inner parts of the support members each having an outer edge of complementary inclination of the gutter inner lower wall part and against which said lower wall part can bear.

15. A combination fascia and concealed gutter system as claimed in claim 1 wherein the fascia member has a medial wide and flat longitudinal inset formation and an upper longitudinal edge portion rolled over to locate on and in an upper arcuate inturned edge portion of each support member outer part, and a lower longitudinal inturned and upturned edge portion arranged to locate over a lower end portion of each support member outer part defining a stepped abutment.

16. A combination fascia and concealed gutter system as claimed in claim 15 wherein the outer part of each support member is provided with upper and lower outwardly directed projections arranged to locate on the inner face of the fascia inset formation at or near the upper and lower edges thereof to support such inset formation in slight spaced relationship from the respective support member outer part.

* * * * *